US006224447B1

(12) United States Patent
Moradi et al.

(10) Patent No.: US 6,224,447 B1
(45) Date of Patent: May 1, 2001

(54) ELECTRODE STRUCTURES, DISPLAY DEVICES CONTAINING THE SAME, AND METHODS FOR MAKING THE SAME

(75) Inventors: Benham Moradi; Zhong-Yi Xia; Tianhong Zhang, all of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/102,223

(22) Filed: Jun. 22, 1998

(51) Int. Cl.[7] ..... H01J 9/02
(52) U.S. Cl. ..... 445/24
(58) Field of Search ..... 445/24, 25

(56) References Cited

U.S. PATENT DOCUMENTS

| | | | | |
|---|---|---|---|---|
| 3,753,022 | | 8/1973 | Fraser, Jr. . | |
| 5,070,282 | | 12/1991 | Epsztein . | |
| 5,186,670 | | 2/1993 | Doan et al. . | |
| 5,191,217 | | 3/1993 | Kane et al. . | |
| 5,229,331 | | 7/1993 | Doan et al. . | |
| 5,235,244 | | 8/1993 | Spindt . | |
| 5,394,006 | * | 2/1995 | Liu | 313/310 |
| 5,451,830 | | 9/1995 | Huang . | |
| 5,528,103 | | 6/1996 | Spindt et al. . | |
| 5,543,691 | | 8/1996 | Palevsky et al. . | |
| 5,644,187 | | 7/1997 | Jaskie et al. . | |
| 5,749,762 | * | 5/1998 | Nakamoto et al. | 445/24 |
| 5,763,987 | * | 6/1998 | Morikawa et al. | 313/309 |
| 5,977,696 | * | 11/1999 | Okamoto | 313/309 |

OTHER PUBLICATIONS

Article entitled "Beam Focusing for Field–Emission Flat–Panel Displays" by W. Dawson Kesling and Charles E. Hunt—IEEE Transactions on Electron Devices, vol. 42, No. 2, pp. 340–347, Feb. 1995.

* cited by examiner

*Primary Examiner*—Kenneth J. Ramsey
(74) *Attorney, Agent, or Firm*—Trask Britt

(57) ABSTRACT

An electrode structure for a display device comprising a gate electrode proximate to an emitter and a focusing electrode separated from the gate electrode by an insulating layer containing a ridge. When the focusing electrode is an aperture-type electrode, the ridge protrudes closer to the emitter than the sidewall of the gate electrode or the sidewall of the focusing electrode. When the focusing electrode is a concentric-type electrode, the ridge protrudes above the upper surface of the gate electrode or the upper surface of the focusing electrode. A method for making the aperture-type and concentric-type electrode structures is described. A display device containing such electrode structures is also described. By forming an insulating ridge between the gate and focusing electrodes, shorting between the two electrodes is reduced and yield enhancement increased.

26 Claims, 7 Drawing Sheets

ELECTRODE STRUCTURES, DISPLAY DEVICES CONTAINING THE SAME, AND METHODS FOR MAKING THE SAME

BACKGROUND OF THE INVENTION

This invention relates to display devices, such as field emission displays, plasma displays, and flat panel cathode ray tubes. Specifically, the invention relates to electrode structures for display devices and methods for making the same.

Display devices visually present information generated by computers and other electronic devices. One category of display devices is electron emitter apparatus, such as a cold cathode field emission display (FED). A FED uses electrons originating from one or more emitters on a baseplate to illuminate a luminescent display screen and generate an image. A gate electrode, located near the emitter, and the baseplate are in electrical communication with a voltage source. Electrons are emitted when a sufficient voltage differential is established between the emitter and the gate electrode. The electrons strike a phosphor coating on the display screen, releasing photons to form the visual image.

Focusing the beam of electrons has become important in high resolution field emission displays, where millions of emitters are located in a small area. High resolution displays require small beam size, which can be achieved by focusing the electron beam. Focusing the beam reduces the effect of individual emitters and reduces off-angle beams and mislanded electrons, yielding a more uniform display.

Focusing the electron beam can be easily performed by using a focusing electrode, such as an aperture-type or concentric-type focusing electrode as described in Kesling et al., *Beam Focusing for Field-Emission Flat-Panel Displays*, IEEE Transactions on Electron Devices, Vol. 42, No. 2, pp. 340–347 (February 1995), incorporated herein by reference. Aperture-type focusing electrodes comprise a grid network of conducting material with an opening above the emitter that allows the electrons to pass through while simultaneously acting as a lens. See U.S. Pat. Nos. 3,753,022, 5,644,187, 5,235,244, 5,191,217, 5,070,282, 5,543,691, 5,451,830, 5,229,331, and 5,186,670, all incorporated herein by reference. Concentric-type focusing electrodes are formed from conductive grids on the same plane as the gate electrode, but separated by a small gap. See U.S. Pat. No. 5,528,103, incorporated herein by reference. The electrons originating from the emitters are deflected in the desired direction by applying an appropriate voltage potential to the focusing electrode.

A problem with both types of focusing electrodes is the close proximity of the focusing electrode with the gate electrode (also known as the extraction grid). When the focusing electrode is close to the gate electrode, small particles can cause the grid electrode and focusing electrode to short and cause failure. Phosphor particles coming off the anode screen and particles disassociating from getter materials during packaging of a FED are examples of small particles that can contribute to such failure.

SUMMARY OF THE INVENTION

The present invention provides an electrode structure for a display device comprising a gate electrode proximate to an emitter and a focusing electrode separated from the gate electrode by an insulating layer containing a ridge. When the focusing electrode is an aperture-type electrode, the ridge is a ledge, i.e., the ridge horizontally protrudes beyond the vertical sidewall of either the gate electrode, the focusing electrode, or both. When the focusing electrode is a concentric-type electrode, the ridge vertically protrudes beyond either the upper surface of the gate electrode, the focusing electrode, or both. The present invention also relates to a display device containing such an electrode structure.

The present invention also provides a method for making an aperture-type electrode structure for a display device by providing a substrate with an emitter disposed thereon, forming a gate electrode proximate the emitter, forming an insulating layer over the gate electrode, and forming a focusing electrode over the insulating layer. The sidewall of the insulating layer horizontally protrudes beyond either the vertical sidewall of the gate electrode, the focusing electrode, or both.

The present invention also provides a method for making a concentric-type electrode structure for a display device by providing a substrate, forming a first insulating layer flanking an emitter on the substrate, forming a gate electrode on the first insulating layer and proximate the emitter, forming a focusing electrode on the first insulating layer, and then forming a second insulating layer between the gate and focusing electrodes. The upper surface of the second insulating layer vertically protrudes beyond either the upper surface of the gate electrode, the focusing electrode, or both. The gate electrode and focusing electrode can be made out of the same conductive material layer by forming a dielectric via therein.

The present invention provides the following advantages over the prior art. By providing an electrode structure with an insulating ridge disposed between the gate and focusing electrodes, shorting between the two electrodes is reduced. Thus, the yield enhancement of display devices containing such an electrode structure is increased.

BRIEF DESCRIPTION OF THE DRAWINGS

The present invention is illustrated in part by the accompanying drawings in which.

DETAILED DESCRIPTION OF THE INVENTION

The present invention provides a method and structure for separating the focusing and gate electrodes of a display device by an insulating region or ridge between the two electrodes. The insulating region or ridge is formed of materials which electrically insulate the focusing electrode and gate electrode, thereby reducing shorting between these two layers.

The following description provides specific details, such as material thicknesses and types, in order to provide a thorough understanding of the present invention. The skilled artisan, however, will understand that the present invention may be practiced without employing these specific details. Indeed, the present invention can be practiced with conventional fabrication techniques employed in the industry.

The process steps and structures described below neither form a complete process flow for manufacturing display devices nor a completed device. Only the process steps and structures necessary to understand the present invention are described.

Figure 1:
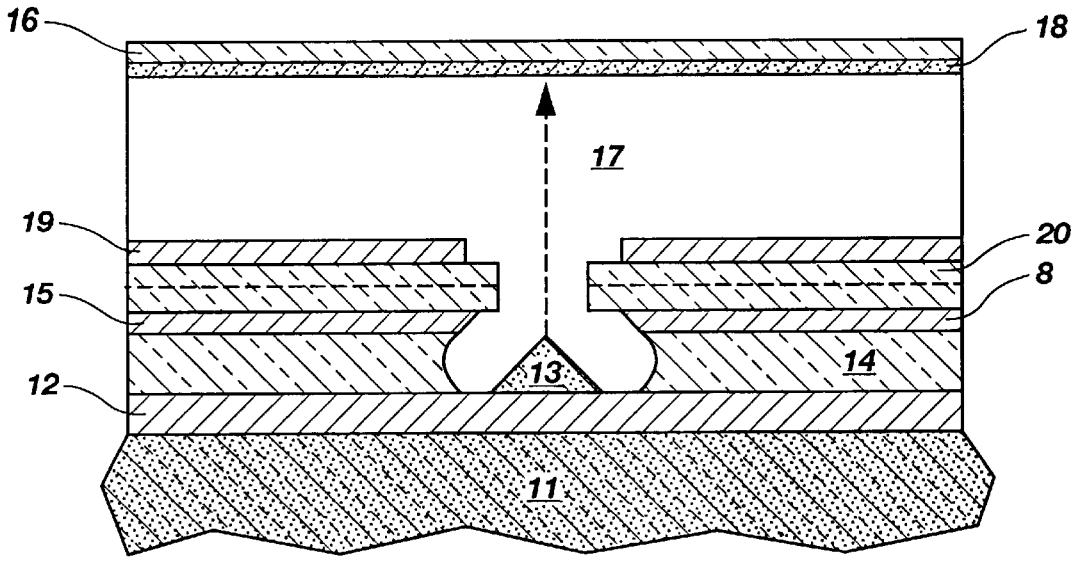
FIGS. 1–8 illustrate cross-sectional views of a process of forming an aperture-type electrode structure, and the electrode structure formed thereby, according to the invention.
Figure 2:
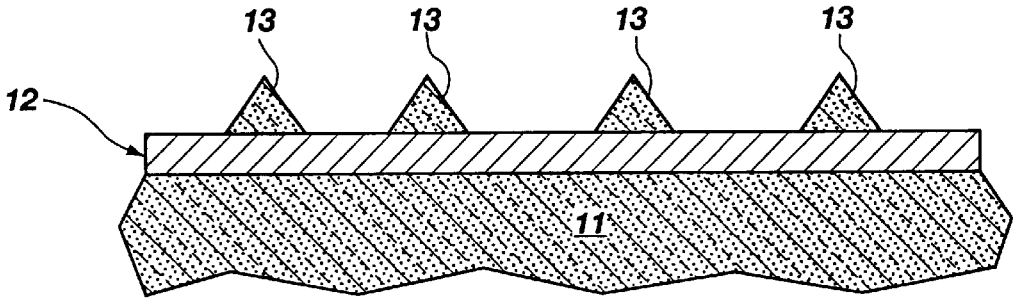

FIGS. 1–8 illustrate the present invention in a FED containing an aperture-type electrode structure. In FIG. 1, which illustrates an aperture-type electrode structure of the present invention, substrate 11 comprises any suitable material, such as glass or a ceramic material. Preferably, a silicon layer serves as substrate 11. The silicon layer may be a silicon wafer or a thin silicon layer, such as a silicon-on-insulator (SOI) or silicon-on-sapphire (SOS) structure. Conductive layer 12 is disposed on substrate 11.

Any conductive material, such as metals including chromium, aluminum, tungsten, and titanium, or metal alloys can be used as conductive layer 12. Preferably, conductive layer 12 is chromium, aluminum, or an alloy thereof when substrate 11 is glass, and conductive layer 12 is aluminum, tungsten, or an alloy thereof when substrate 11 is silicon. Emitter tip 13 is positioned on substrate 11 and conductive layer 12. Emitter tip 13 serves as a cathode conductor, and although any shape providing the necessary emitting properties can be used, a conical shape is preferred. Emitter tip 13 may comprise any emitting material, but preferably comprises a low work function material—a material which requires little energy to emit the electrons—such as silicon or molybdenum.

Surrounding emitter tip 13 is gate electrode 15. Gate electrode 15 is formed of a conductive material, such as tungsten (W), chromium, or molybdenum. Preferably, gate electrode 15 comprises W. When a voltage differential is applied between emitter tip 13 and gate electrode 15, a stream of electrons in the form of electron beam 17 is emitted toward display screen 16 (serving as an anode) with phosphor coating 18. Electron beam 17 tends to diverge, becoming wider at greater distances from emitter tip 13.

Insulating layer 14 is disposed between conductive layer 12 and gate electrode 15. Any insulating material may be used as insulating layer 14, such as silicon nitride or silicon oxide. Insulating layer 14 flanks emitter tip 13.

Focusing electrode 19, preferably in the form of a ring, is provided between display screen 16 and gate electrode 15. Focusing electrode 19 collimates electron beam 17 originating from each emitter tip 13 and reduces the area where the beam impinges on the phosphor-coated screen 16, thus improving the image resolution.

Insulating layer 20 is located between gate electrode 15 and focusing electrode 19, having an insulating ridge (e.g., a sidewall) extending closer to the path of the electrons from emitter tip 13 than either the gate electrode, the focusing electrode, or both. Insulating layer 20 serves to separate and insulate gate electrode 15 and focusing electrode 19 and the voltage differential between them. Any insulating material exhibiting such properties can be employed as insulating layer 20, such as dielectric materials like silicon nitride or silicon oxide. Preferably, insulating layer 20 comprises silicon oxide.

Optionally, insulating layer 8 is disposed between insulating layer 20 and gate electrode 15, as shown by the dotted line in FIG. 1. Insulating layer 8, when present, functions as an etch stop as explained below. Any insulating material exhibiting the necessary etch stop properties, such as dielectric materials like silicon nitride or silicon oxide, can be employed as insulating layer 8.

A FED containing the aperture-type focusing electrode of the present invention can be formed by many processes, including the process described below and illustrated in FIGS. 2–8. A P-type silicon layer, preferably single crystal silicon, is used as a substrate to form the emitters. In this silicon layer a series of elongated parallel N-conductivity regions or wells are formed by a doping process, such as diffusion and/or ion implantation. The size and spacing of the wells can be adjusted to accommodate any number of field emission sites. If desired, the P-type and N-type conductivities can be reversed. The undoped portions of the silicon layer are then selectively removed, leaving doped wells in the general shape and size of the emitters. The surface of the silicon layer and the emitters are then oxidized to produce a layer of silicon oxide, and then etched to produce emitter tip 13. Any suitable oxidation process may be employed in forming the silicon oxide and any suitable etching process may be used to etch the tip.

The emitters can also be formed by an alternative process. In the alternative process, the silicon layer—or any other suitable material for the emitters—is provided. Then, a layer of silicon oxide—or other suitable masking material for the underlying layer—is formed over the silicon layer. Portions of the silicon oxide layer are then removed, preferably by a photolithographic patterning and etching process, to leave an oxide etch mask overlying the emitter sites. The silicon layer is then anisotropically etched, removing portions of the silicon layer underlying the oxide etch mask as well as portions not underlying the etch mask and forming emitter tips 13. The oxide mask is then removed.

Figure 3:
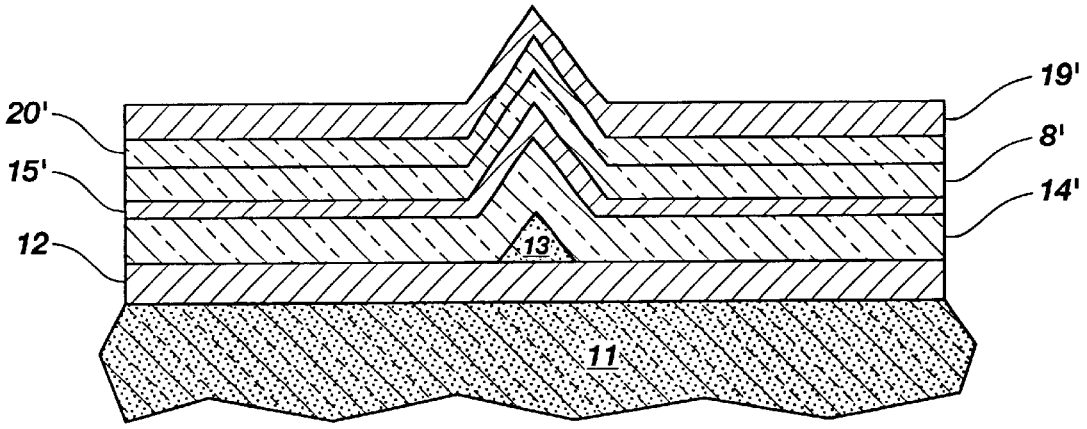

Next, as illustrated in FIG. 3, first insulating layer 14' is deposited. This insulating layer is selectively etchable with respect to the conductive layer 15', as explained below. Suitable selectively-etchable materials include silicon nitride, silicon oxide, and silicon oxynitride. Preferably, silicon oxide is employed as insulating layer 14'. The thickness of insulating layer 14' will determine the spacing of gate electrode 15 to emitter tip 13, as well as the spacing of gate electrode 15 to conductive layer 12. Therefore, insulating layer 14' must be as thin as possible, since small gate electrode 15 to emitter tip 13 distances result in lower emitter drive voltages. Yet the thickness must be large enough to prevent the oxide breakdown which occurs if gate electrode 15 is not adequately separated from conductive layer 12. For example, the thickness may range from about 0.3 to about 0.5 microns, and is preferably about 0.35 microns. Preferably, as depicted in FIG. 3, insulating layer 14' is a conformal layer-the layer is deposited so it conforms to the shape of emitter tip 13.

Next, conductive layer 15' is deposited. Conductive layer 15' may comprise any conductive material, such as polysilicon, tungsten, chromium, molybdenum, titanium, aluminum, or alloys thereof. The preferred conductive material is W. While conductive layer 15' may be deposited by any method, it is preferably deposited by a chemical vapor deposition process, such as sputtering. The thickness of conductive layer 15' may range from about 0.5 to about 0.7 microns, and is preferably about 0.6 microns.

If desired, second insulating layer 8' is then deposited. Insulating layer 8' may comprise any appropriate insulating material such as dielectric materials like silicon dioxide, silicon nitride, and silicon oxynitride. Preferably, insulating layer 8' is silicon nitride. The thickness of insulating layer 8' will, in part, determine the spacing between gate electrode 15 and focusing electrode 19. Accordingly, the thickness of insulating layer 8' can range from about 0.4 to about 0.5 microns, and is preferably about 0.4 microns.

Third insulating layer 20' is next formed. Third insulating layer 20' may comprise any appropriate insulating material, such as dielectric materials like silicon dioxide, silicon nitride, and silicon oxynitride. Preferably, insulating layer 20' comprises silicon oxide. The thickness of insulating layer 20' also determines, in part, the spacing between gate electrode 15 and focusing electrode 19. Accordingly, the thickness of third insulating layer 20' can range from about 0.3 to about 0.5 microns, and is preferably about 0.4 microns.

Next, conductive layer 19' is formed on third insulating layer 20'. Conductive layer 19' comprises any conductive material including metals such as aluminum, titanium, tungsten, chromium, molybdenum, or their alloys. Preferably, conductive layer 19' comprises W. While conductive layer 19' may be deposited by any method, it is preferably deposited by a chemical vapor deposition process, such as sputtering. The thickness of conductive layer 19' may range from about 0.4 to about 0.6 microns, and is preferably about 0.5 microns.

Optionally, a layer of buffer material may be deposited on conductive layer 19' to prevent undesired etching of portions of the conductive layer 19' during the chemical-mechanical polishing (CMP) step which follows. A suitable buffering material is silicon nitride.

Figure 4:
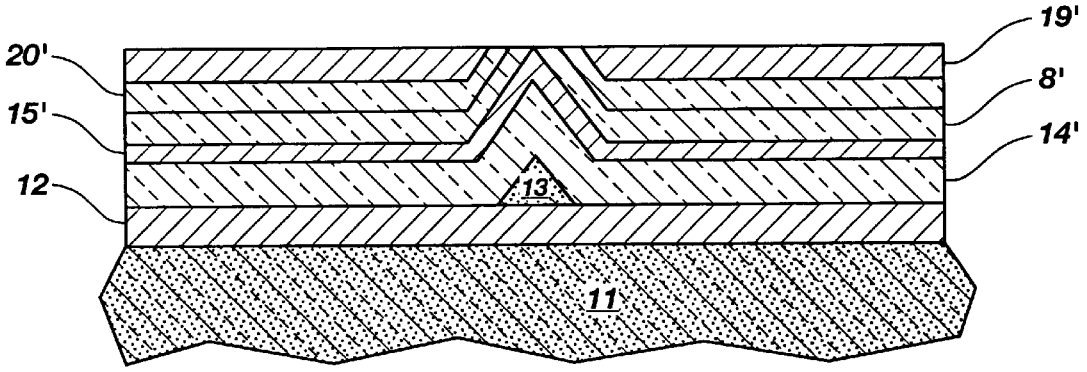

Next, a CMP step is performed on the structure of FIG. 3. This CMP step holds or rotates the structure of FIG. 3 against a wetted polishing surface in the presence of a chemical slurry and abrasive agents, such as alumina or silica. Through the chemical and abrasive attack, the buffer material as well as other layers (e.g., peaks of conductive layer 19' and insulating layers 8' and 20') are removed. After the CMP step, a substantially planar surface is achieved as depicted in FIG. 4.

Figure 5:
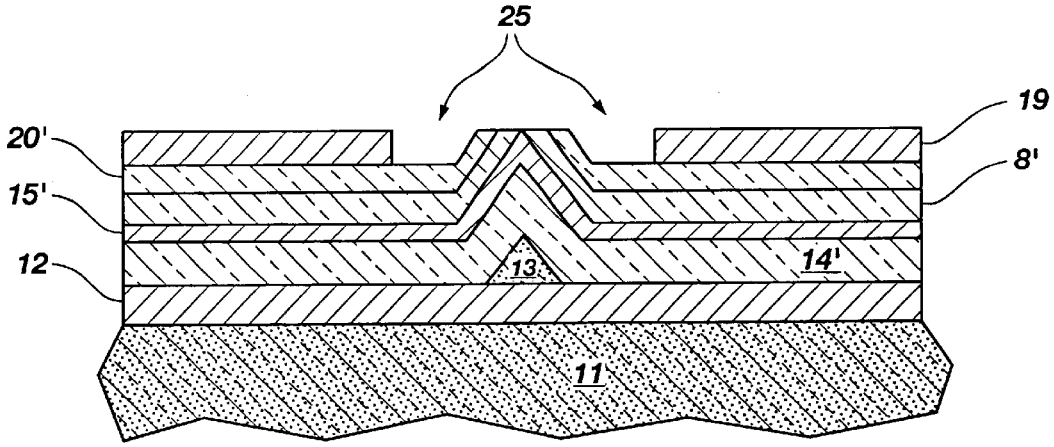

As illustrated in FIG. 5, opening 25 is then formed in conductive layer 19', thus defining focusing electrode 19. Opening 25 is located above emitter tip 13 so the resulting focusing electrode 19 can collimate electron beam 17. Any removal process which forms opening 25 without attacking or degrading exposed portions of insulating layers 8' and 20' can be employed. Preferably, opening 25 is formed by a photopattern and etch process.

Figure 6:
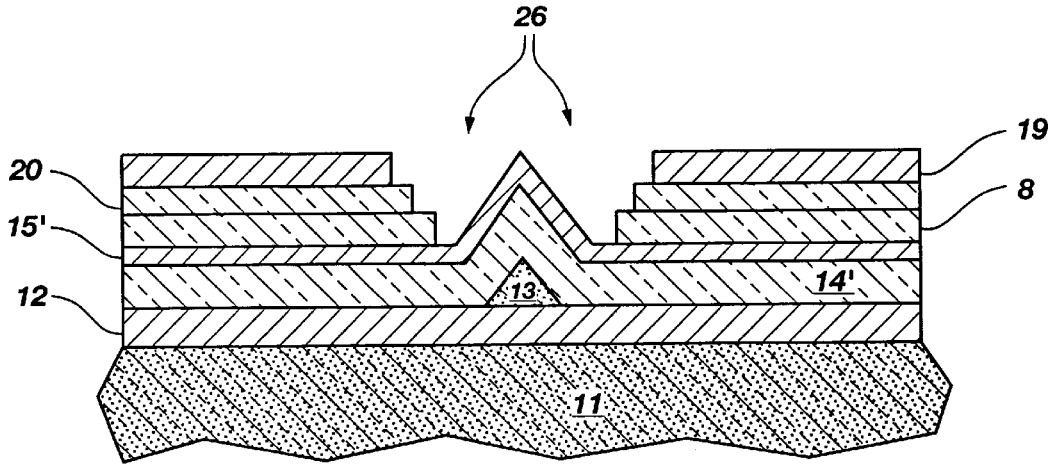

As illustrated in FIG. 6, opening 26 is formed in third insulating layer 20' and second insulating layer 8', if present, resulting in insulating layers 20 and 8, respectively, containing an insulating ridge. Opening 26 is narrower than opening 25. When insulating layer 8 is present, the sidewalls of insulating layers 8 and 20 may be aligned in the same vertical plane, as illustrated in FIG. 1, or may be vertically offset from one another, as depicted in FIG. 6.

Opening 26 is formed by removing selected portions of insulating layers 20' and 8', i.e., the inner portions of insulating layers 20' and 8' which extend closer to emitter tip 13 than focusing electrode 19. Any removal process forming opening 26, without attacking or degrading the exposed portions of conductive layer 15' or focus electrode 19 can be employed. Preferably, opening 26 is formed by a photopattern and etch process. When insulating layer 8' is present, insulating layer 8' serves as an etch stop in this etch process.

Figure 7:
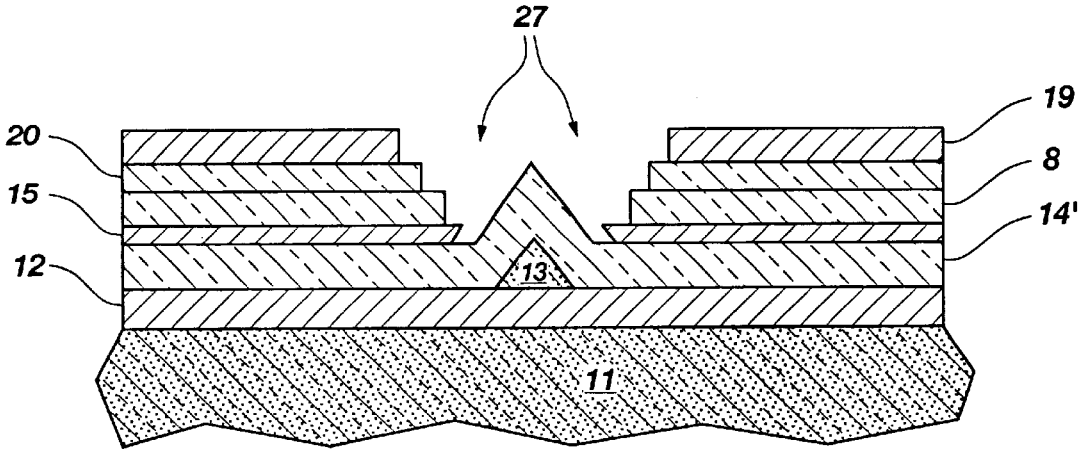

As illustrated in FIG. 7, opening 27 is then formed in conductive layer 15', thus defining gate electrode 15. Opening 27 may be wider than opening 26, and may be similar to or different from the width of opening 25. Opening 27 is defined so that when a voltage potential is applied, gate electrode 15 extracts electrons from emitter tip 13. Any removal process of forming opening 27 without attacking or degrading focusing electrode 19, insulating layers 20, 8, or 14' can be employed. Preferably, opening 27 is defined by a photopattern and etch process.

Figure 8:
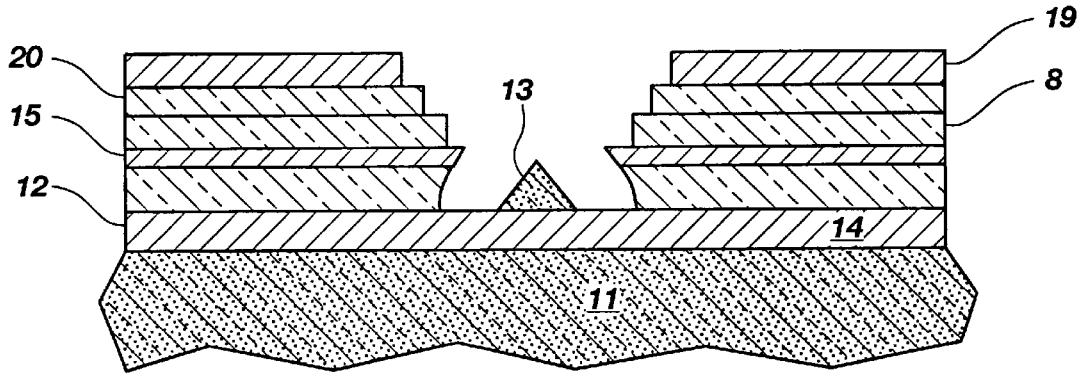

Removing portions of conductive layer 15' exposes first insulating layer 14', Portions of insulating layer 14' near the emitter are then removed to expose emitter tip 13, as shown in FIG. 8. Any removal process which does not attack or degrade emitter tip 13 or the rest of the then-existing structure can be employed. Preferably, portions of insulating layer 14' are removed by a wet etching process which selectively attacks insulating layer 14'.

If desired, emitter tip 13 may be coated with a low work function material. Any suitable process known in the art can be employed to coat the emitter tips with the low work function material.

Variations of the above structure and method are possible. If desired, it is possible to fabricate several focus electrodes by adding successive insulating layers and conductive layers prior to the CMP step.

Figure 9:
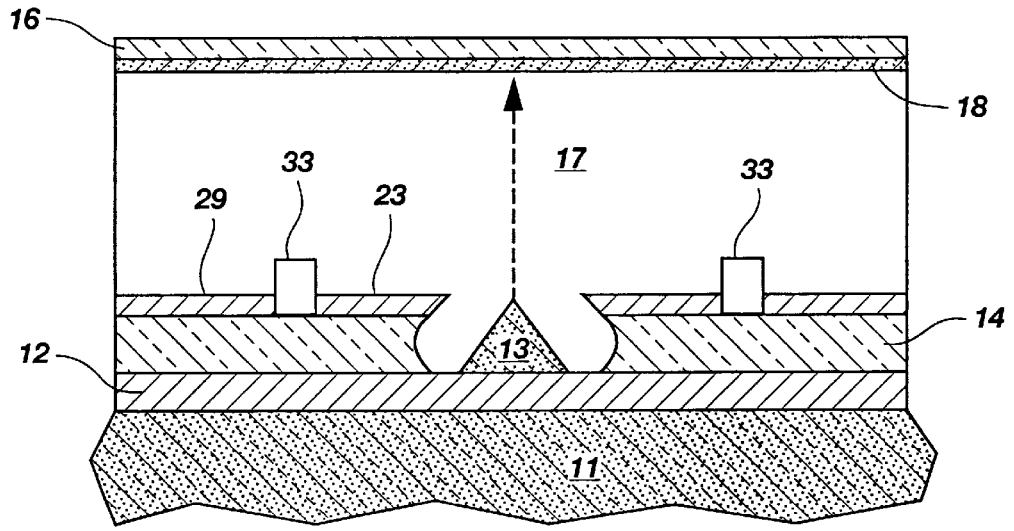
FIGS. 9–14 illustrate cross-sectional views of a process of forming a concentric-type electrode structure, and the electrode structure formed thereby, according to the invention.

FIGS. 9–14 illustrate the present invention in a FED containing a concentric-type electrode structure. A concentric-type electrode structure differs from an aperture-type electrode structure in that the focusing electrode 29, rather than located above, is located to the sides of the gate electrode, as shown in FIG. 9. In the present invention, gate electrode 23 and focusing electrode 29 are separated by an insulating layer containing insulating ridge 33, i.e., an upper surface extending above the upper surface of either the gate or focusing electrode. Like the aperture-type focusing electrode, the concentric-type focusing electrode collimates electron beam 17 emitted from each emitter tip and reduces the area where the beam impinges on the phosphor coated screen 16, thus improving the image resolution. Insulating ridge 33 separates gate electrode 23 and focusing electrode 29 and insulates the voltage differential between them.

Figure 10:
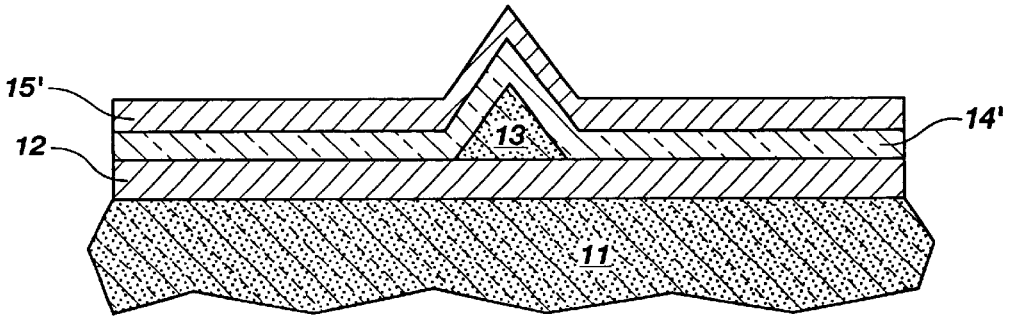
Figure 11:
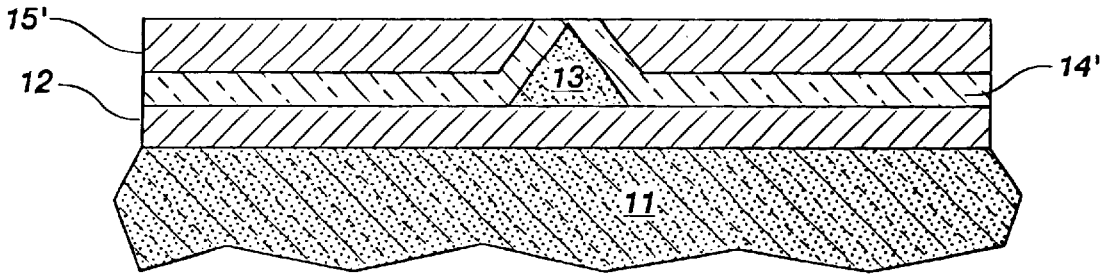

A FED containing a concentric-type focus electrode is manufactured similar to the process for making the FED containing the aperture-type focus electrode described above ("the aperture process"), at least until conductive layer 15' has been formed as shown in FIG. 10. A buffer layer may then deposited on conductive layer 15' and a CMP process performed to expose underlying insulating layer 14' as illustrated in FIG. 11.

Figure 12:
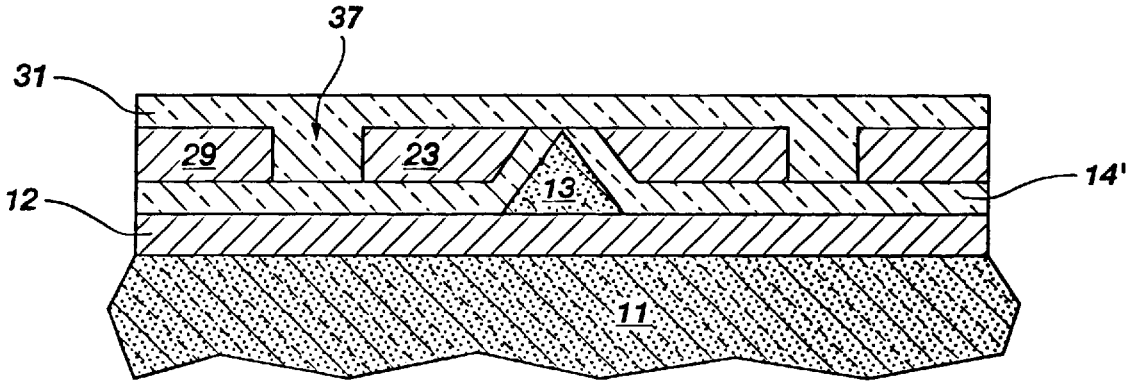

Portions of conductive layer 15' are then removed, as shown in FIG. 12, to define focusing electrode 29 and gate electrode 23 separated by opening 37. The portions of conducting layer 15' may be removed by any appropriate method, such as a photopattern and etch process.

Next, insulating layer 31 is deposited. Insulating layer 31 comprises any insulating material, such as dielectric materials like silicon dioxide, silicon nitride, and silicon oxynitride. Preferably, insulating layer 31 is silicon oxide. Insulating layer 31 is preferably formed by a non-conformal process, thereby filling opening 37 and yielding a substantially planar upper surfaces above the upper surface of gate electrode 23 and focusing electrode 29.

Figure 13:
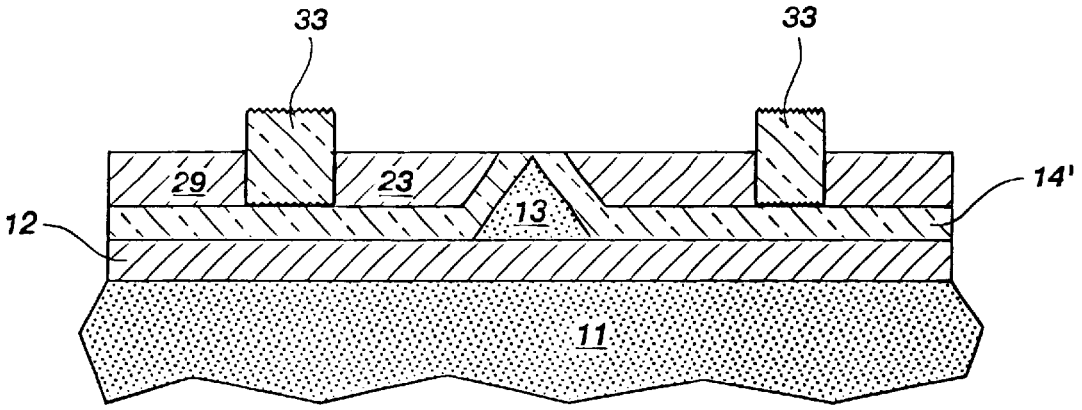

Next, as depicted in FIG. 13, insulating layer with insulating ridge 33 is formed. Insulating ridge 33 is formed by removing all portions of insulating layer 31 except those portions in and above opening 27. Any process can be employed to remove insulating layer 31, provided such process does not attack or degrade focusing electrode 29 and gate electrode 23. Preferably, a photopattern and etch process is employed to remove portions of insulating layer 31 and form insulating ridge 33.

Figure 14:
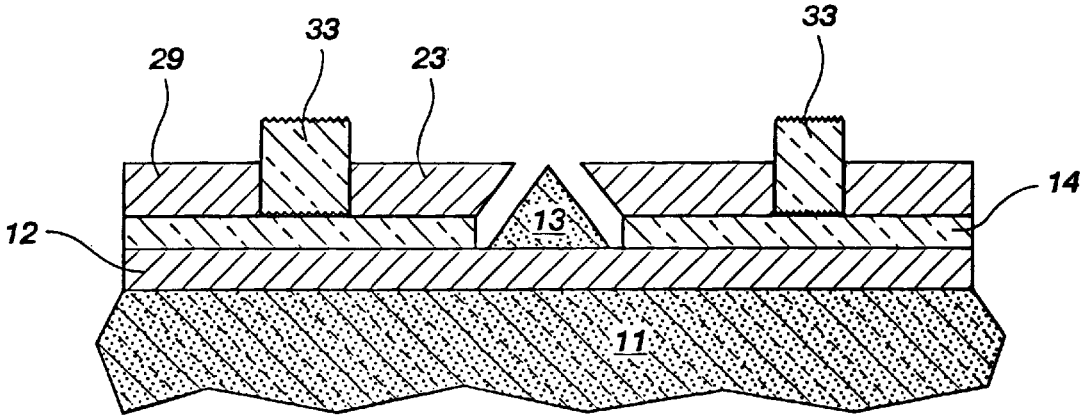
Figure 1:
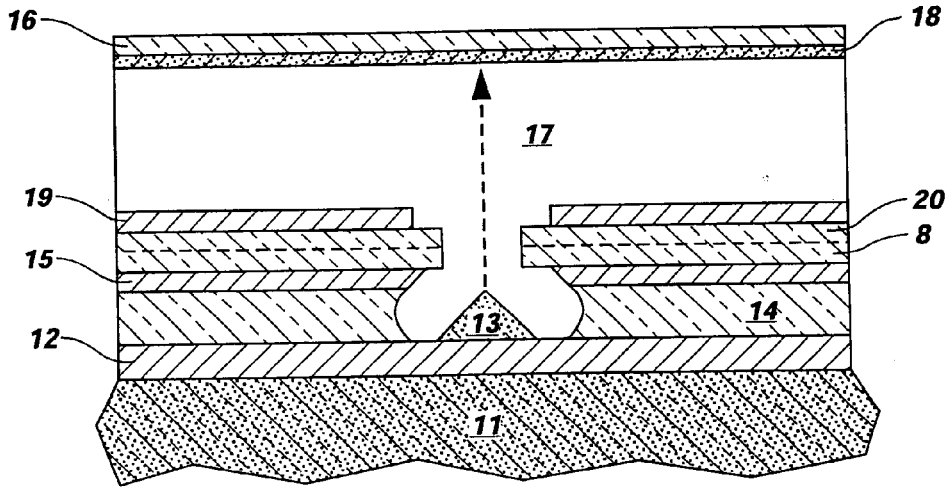
Figure 2:
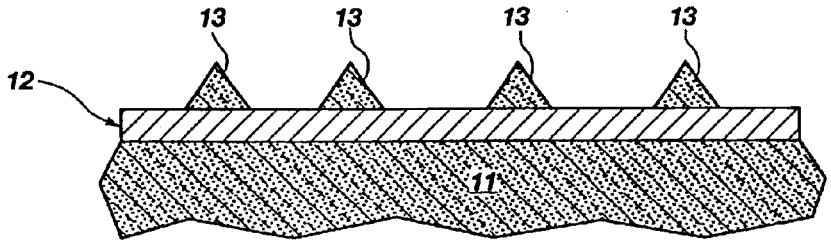
Figure 7:
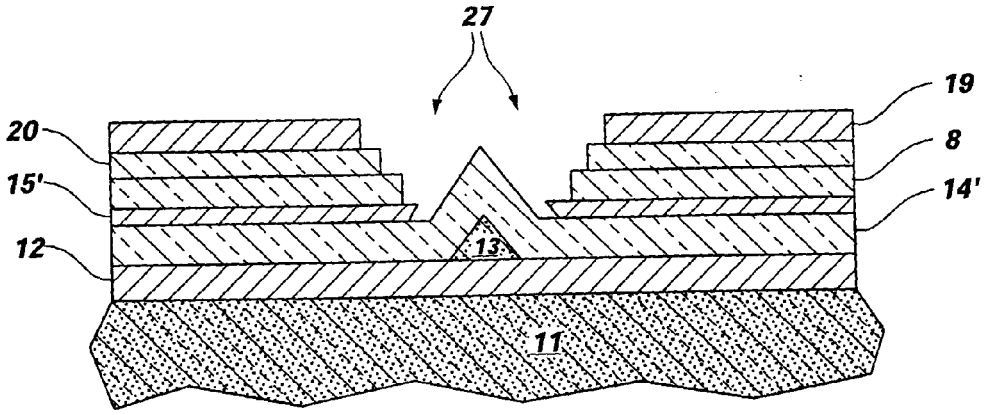
Figure 8:
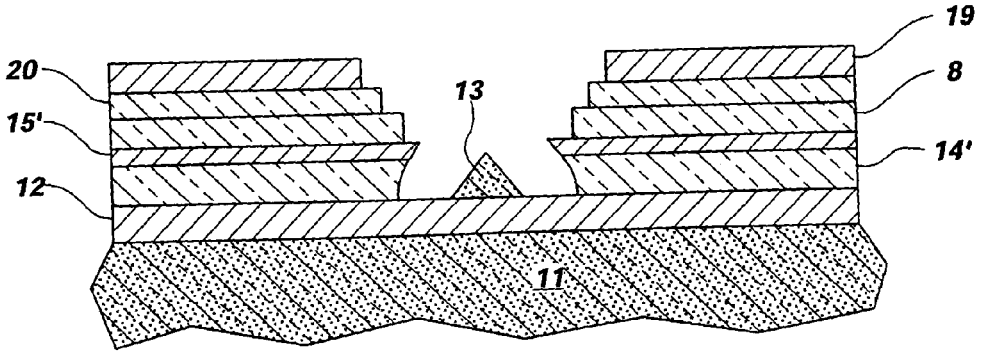
Figure 13:
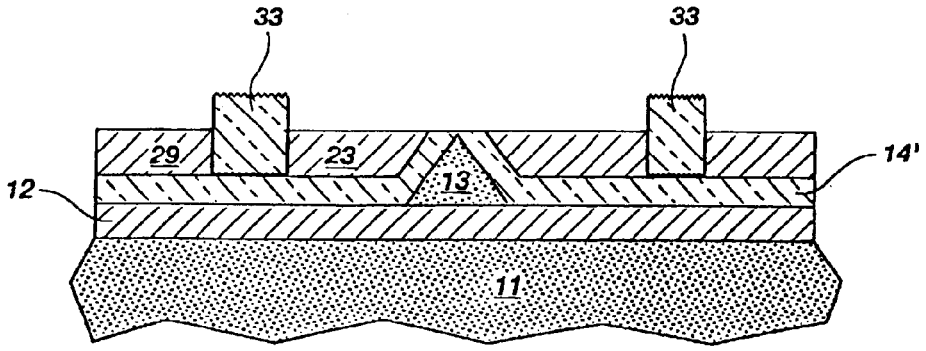
Figure 14:
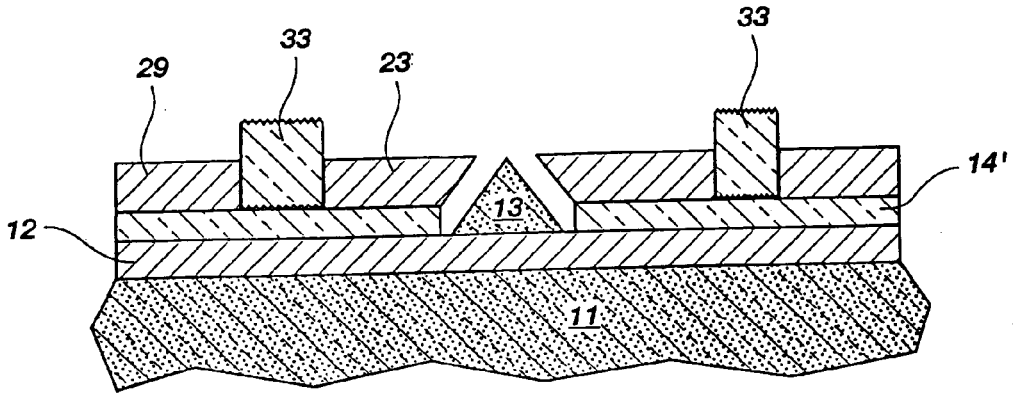

Next, like the aperture process and as shown in FIG. 14, emitter tip 13 is exposed by removing portions of insulating layer 14' near the tip.

Variations of the above structure and method are possible. If desired, a dual-insulating ridge can be fabricated by forming successive insulating layers instead of a single insulating layer. Moreover, additional focusing electrodes could be formed by forming additional vias in conductive layer 15', Further, while the gate electrode and focus structure described above are preferably made of the same material and therefore require a single conducting layer, it is possible, but not preferable, to modify the process to obtain two separate conducting layers, one for the gate electrode and another for the focus electrode.

While the preferred embodiments of the present invention have been described above, the invention defined by the appended claims is not to be limited by particular details set forth in the above description, as many apparent variations thereof are possible without departing from the spirit or scope thereof. For example, although the method of the invention has been described as forming interelectrode spacers for a FED, the skilled artisan will understand that the process and spacers described above can be used for other display devices, such as plasma displays and flat cathode ray tubes.

We claim:

1. A method for making an aperture-type electrode structure for a display device, comprising:

providing a substrate;

forming a first insulating layer flanking an emitter on the substrate;

forming a gate electrode on the first insulating layer and proximate the emitter;

forming a second insulating layer containing a ridge over the gate electrode; and forming a focusing electrode over the second insulating layer.

2. The method of claim 1, further comprising forming the gate electrode by forming a layer of conductive material on the first insulating layer and the emitter and then forming an opening in the conductive material layer above the emitter.

3. The method of claim 1, further comprising forming the conductive material layer by deposition and forming the opening by photopatterning and etching the conductive material layer.

4. The method of claim 1, wherein the conductive material layer comprises polysilicon, aluminum, titanium, or tungsten.

5. The method of claim 1, wherein the conductive material is tungsten.

6. The method of claim 1, further comprising forming the focusing electrode by forming a layer of conductive material on the second insulating layer and then forming an opening in the conductive material layer above the emitter.

7. The method of claim 6, further comprising forming the conductive material layer by deposition and forming the opening by chemical-mechanical polishing the conductive material layer.

8. The method of claim 7, wherein the conductive material layer comprises aluminum, titanium, or tungsten.

9. The method of claim 8, wherein the conductive material is tungsten.

10. The method of claim 1, further comprising forming the second insulating layer by depositing a layer of insulating material over the gate electrode and then forming an opening in the insulating material layer above the emitter.

11. The method of claim 10, further comprising forming the opening by etching the insulating material layer.

12. The method of claim 11, wherein the insulating material is silicon oxide.

13. The method of claim 1, further comprising forming a third insulating layer on the gate electrode before forming the second insulating layer.

14. The method of claim 13, wherein the third insulating layer comprises silicon nitride.

15. The method of claim 13, further comprising forming the third insulating layer by depositing a layer of insulating material over the gate electrode and then forming an opening in the insulating material layer above the emitter.

16. The method of claim 15, further comprising forming the opening by etching the insulating material layer.

17. The method of claim 1, wherein a sidewall of the first insulating layer protrudes closer to the emitter than either a sidewall of the gate electrode or a sidewall of the focusing electrode.

18. A method for making a concentric-type electrode structure for a display device, comprising:

providing a substrate;

forming a first insulating layer flanking an emitter on the substrate;

forming a gate electrode on the first insulating layer and proximate the emitter;

forming a focusing electrode on the first insulating layer; and forming a second insulating layer containing a ridge between the gate and focusing electrodes.

19. The method of claim 18, further comprising forming the gate electrode by depositing a layer of conductive material over the first insulating layer and then forming an opening in the conductive material layer above the emitter.

20. The method of claim 19, further comprising forming the focusing electrode by forming a via in the conductive material layer in a position remote from the emitter.

21. The method of claim 20, wherein the conductive material layer comprises aluminum, titanium, or tungsten.

22. The method of claim 21, wherein the conductive material is tungsten.

23. The method of claim 20, comprising forming the second insulating layer by depositing a layer of insulating material in the via and over the gate and focusing electrodes and removing portions of the insulating material layer above the gate and focusing electrodes.

24. The method of claim 23, wherein the portions of the insulating material layer are removed by photopatterning and etching.

25. The method of claim 23, wherein the insulating material is silicon oxide.

26. The method of claim 18, wherein the upper surface of the second insulating layer protrudes above the upper surface of the gate electrode or the focusing electrode.

* * * * *

UNITED STATES PATENT AND TRADEMARK OFFICE

CERTIFICATE OF CORRECTION

PATENT NO. : 6,224,447 B1
DATED : May 1, 2001
INVENTOR(S) : Moradi et al.

It is certified that error appears in the above-identified patent and that said Letters Patent is hereby corrected as shown below:

Delete Title page illustrating figure, and substitute therefor attached new Title page illustrating figure.

Delete drawing sheets 1, 4 & 7 and substitute therefor attached drawing sheets 1, 4 & 7.

Column 4,
Line 54, change "Insulating" at beginning of line to -- Second insulating --
Lines 56, 57 and 60, before "insulating" insert -- second --

Column 5,
Line 66, after "14" and before "Portions" insert -- . --

Column 6,
Line 36, after "then" insert -- be --
Line 50, change "surfaces" to -- surface -- and change "surface" to -- surfaces --
Line 55, change "27" to -- 37 --

Column 7,
Line 1, change "insulating layer." to -- focusing electrode --

Column 8,
Line 44, before "comprising" insert -- further --

Signed and Sealed this

Fourteenth Day of September, 2004

JON W. DUDAS
*Director of the United States Patent and Trademark Office*

(12) United States Patent
Moradi et al.

(10) Patent No.: US 6,224,447 B1
(45) Date of Patent: May 1, 2001

(54) ELECTRODE STRUCTURES, DISPLAY DEVICES CONTAINING THE SAME, AND METHODS FOR MAKING THE SAME

(75) Inventors: Benham Moradi; Zhong-Yi Xia; Tianhong Zhang, all of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/102,223

(22) Filed: Jun. 22, 1998

(51) Int. Cl.[7] ..... H01J 9/02
(52) U.S. Cl. ..... 445/24
(58) Field of Search ..... 445/24, 25

(56) References Cited

U.S. PATENT DOCUMENTS

| | | | | |
|---|---|---|---|---|
| 3,753,022 | | 8/1973 | Fraser, Jr. . | |
| 5,070,282 | | 12/1991 | Epsztein . | |
| 5,186,670 | | 2/1993 | Doan et al. . | |
| 5,191,217 | | 3/1993 | Kane et al. . | |
| 5,229,331 | | 7/1993 | Doan et al. . | |
| 5,235,244 | | 8/1993 | Spindt . | |
| 5,394,006 | * | 2/1995 | Liu | 313/310 |
| 5,451,830 | | 9/1995 | Huang . | |
| 5,528,103 | | 6/1996 | Spindt et al. . | |
| 5,543,691 | | 8/1996 | Palevsky et al. . | |
| 5,644,187 | | 7/1997 | Jaskie et al. . | |
| 5,749,762 | * | 5/1998 | Nakamoto et al. | 445/24 |
| 5,763,987 | * | 6/1998 | Morikawa et al. | 313/309 |
| 5,977,696 | * | 11/1999 | Okamoto | 313/309 |

OTHER PUBLICATIONS

Article entitled "Beam Focusing for Field–Emission Flat–Panel Displays" by W. Dawson Kesling and Charles E. Hunt—IEEE Transactions on Electron Devices, vol. 42, No. 2, pp. 340–347, Feb. 1995.

* cited by examiner

*Primary Examiner*—Kenneth J. Ramsey
(74) *Attorney, Agent, or Firm*—Trask Britt

(57) ABSTRACT

An electrode structure for a display device comprising a gate electrode proximate to an emitter and a focusing electrode separated from the gate electrode by an insulating layer containing a ridge. When the focusing electrode is an aperture-type electrode, the ridge protrudes closer to the emitter than the sidewall of the gate electrode or the sidewall of the focusing electrode. When the focusing electrode is a concentric-type electrode, the ridge protrudes above the upper surface of the gate electrode or the upper surface of the focusing electrode. A method for making the aperture-type and concentric-type electrode structures is described. A display device containing such electrode structures is also described. By forming an insulating ridge between the gate and focusing electrodes, shorting between the two electrodes is reduced and yield enhancement increased.

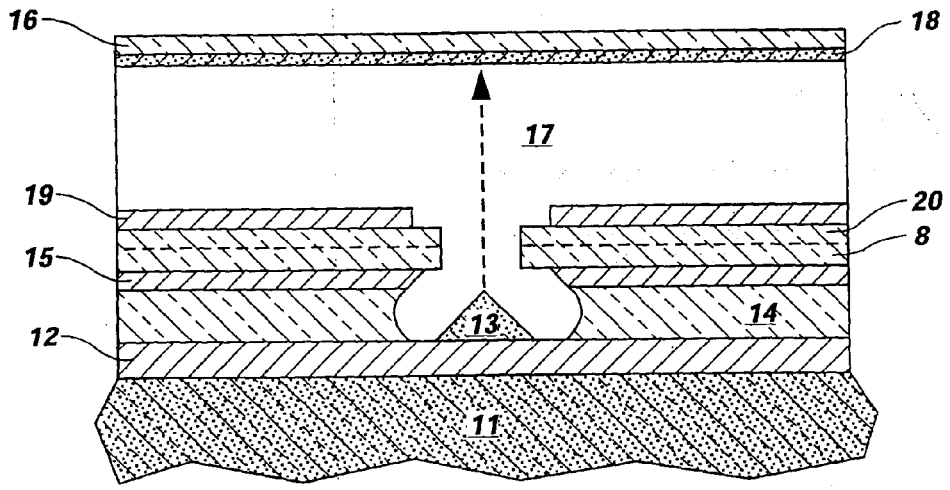

26 Claims, 7 Drawing Sheets